US005111760A

United States Patent [19]

Garzone, Jr.

[11] Patent Number: 5,111,760

[45] Date of Patent: May 12, 1992

[54] DOUBLE-EMBROIDERED LACE

[76] Inventor: Raymond G. Garzone, Jr., 505 Fordham Pl., Paramus, N.J. 07652

[21] Appl. No.: 369,726

[22] Filed: Jun. 22, 1989

[51] Int. Cl.[5] ..... D05C 17/00

[52] U.S. Cl. ..... 112/439; 112/403; 28/164

[58] Field of Search ..... 112/403, 439; 28/164

[56] References Cited

U.S. PATENT DOCUMENTS

| | | | |
|---|---|---|---|
| 280,094 | 6/1883 | Suter | 28/164 |
| 315,589 | 4/1885 | Wuillemin | 112/439 |
| 322,582 | 7/1885 | Cornely | 112/404 |
| 358,156 | 2/1887 | Juncker | 112/403 |
| 466,566 | 1/1892 | Jenny | 112/403 |
| 525,738 | 8/1894 | Hauser | 28/164 |
| 741,302 | 10/1903 | Buff | 112/403 |
| 865,640 | 9/1907 | Häberer | 28/164 |
| 1,581,936 | 4/1926 | Lehmann | 112/439 |
| 1,771,154 | 2/1930 | Stern | 112/439 |
| 1,835,866 | 12/1931 | Harold | 28/164 |
| 1,976,686 | 10/1934 | Waterfield | 112/439 |
| 2,132,603 | 10/1938 | Brickner | 112/439 X |
| 2,365,315 | 12/1944 | Willimsa . | |
| 3,315,329 | 4/1967 | Yoshioka | 28/164 X |
| 3,377,678 | 4/1968 | Moriya | 28/164 |
| 3,438,107 | 4/1969 | Gula et al. | 28/164 |
| 3,463,692 | 8/1969 | Brunner | 112/439 X |
| 3,498,737 | 3/1970 | Robinson et al. | 28/164 X |
| 3,766,872 | 2/1973 | Krieger . | |
| 4,073,299 | 2/1978 | Murata | 112/439 X |
| 4,570,311 | 2/1986 | Kawamura et al. | 28/164 |
| 4,788,922 | 12/1988 | Clarius | 112/403 |

*Primary Examiner*—Paul T. Sewell
*Assistant Examiner*—BethAnne C. Cicconi
*Attorney, Agent, or Firm*—Weingram & Zall

[57] ABSTRACT

A multi-embroidered lace comprising a first design made of metallic or lustrous type of yarn embroidered onto a ground fabric using an insoluble back thread. A second and different design made of a different yarn from the first is embroidered over the first design utilizing an insoluble back thread. The ground fabric may or may not be soluble as desired.

6 Claims, 2 Drawing Sheets

DOUBLE-EMBROIDERED LACE

BACKGROUND OF THE INVENTION

I. Field of the Invention

This invention relates, generally, to the manufacture of lace and more particularly to the embroidering of one layer on top of another in order to form lace.

I. Prior Art

Embroidery and lace are well known. Embroidery is the ornamentation of fabric with needlework having fanciful details. On the other hand, lace is a delicate fabric made of yarn or thread having an open web-like pattern. Typically, the term embroidered lace is used to indicate a delicate-type fabric having open web-like fine detailed patterns.

Traditionally, lace was hand-sewn due to its delicate nature and was hence more expensive to manufacture and use than embroidery.

In U.S. Pat. No. 315,589, "Lace and the Art of Making the Same", (1885) to Wuillemin, a thread is embroidered onto a dissoluble background. Figures are embroidered adjacent each other and are connected to each other by understitching.

U.S. Pat. No. 322,582, "Imitation Bead Embroidery", (1885) to Cornely describes the concept of forming an outline of a design by using a "shiny material" such as leather, metal and the like.

U.S. Pat. No. 358,156, "Foundation For Embroidered Lace", (1887) to Juncker improves upon the manufacture of lace by utilizing a soluble background made of India rubber, gutta-percha or gum.

U.S. Pat. No. 2,365,315, "Manufacture of Fabric", (1944) to Williams describes producing a lace fabric by stitching the fabric on a support or base material comprised essentially of a soluble polyvinyl alcohol film.

U.S. Pat. No. 3,766,872, "Textured Embroidered Fabric", (1973) to Krieger, describes a type of double-embroidery wherein a face yarn is stitched to a non-soluble ground fabric. The face yarn ends are secured by soluble bobbin yarn while a second face yarn is stitched over a part of the first face yarn. The ends of the second yarn are secured by an insoluble bobbin yarn. Therefore, when the soluble bobbin yarn is dissolved, the partial overlay of the second over the first face yarn holds the first yarn in place with the result that the embroidered pattern has a "textured" or of quilted appearance. The use of a non-soluble ground fabric is important in order for one to obtain this "textured" or quilted look. However, it is evident that the base material could not be dissolved since it is necessary to hold the entire object together.

U.S. Pat. No. 4,788,922, "Adhesively Applied Schiffli Embroidery", (1988) to Clarius teaches the use of heat sealing an embroidered design to another article.

These and numerous other ideas have helped promote the use of embroidered designs and lace resulting in low-priced items which include lace.

Heretofore Applicant knows of no efforts made in double embroidery lace. That is, the embroidery of one yarn over another embroidered yarn all on a background fabric.

OBJECTS AND SUMMARY OF THE INVENTION

Accordingly, it is an object of the present invention to provide an embroidered fabric which comprises an embroidery disposed on top of another embroidery, all of which is disposed on a background.

It is yet another object of the present invention to provide an embroidered fabric comprised of at least one first yarn over at least one second yarn either or both of which may be embroidered, all of which is disposed on top of a soluble background.

Still another object of the present invention is to dispose a conventional yarn over a lustrous yarn all of which is disposed on a background which may or may not be soluble thereby producing embroidery or lace.

Still a further object is to produce an embroidered fabric, comprising a soluble or insoluble base material, a first insoluble yarn embroidered onto said base material, and a second insoluble yarn embroidered at least in part on said first insoluble yarn wherein the first and second insoluble yarn is secured to the base material by an insoluble back or bobbin yarn.

DESCRIPTION OF THE DRAWINGS

Reference may be now had to the accompanying drawings in which.

DESCRIPTION OF THE PREFERRED EMBODIMENT

Figure 1:
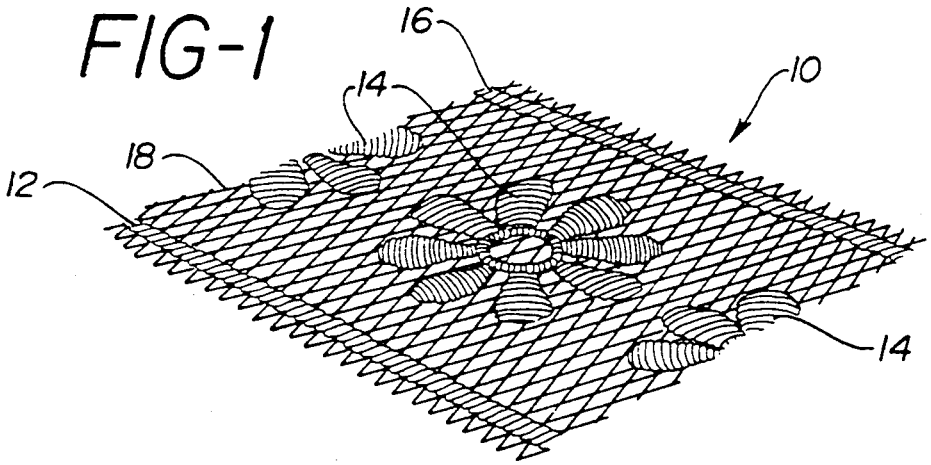
FIG. 1 is a perspective view of the embroidered fabric of the present invention.
Figure 4:
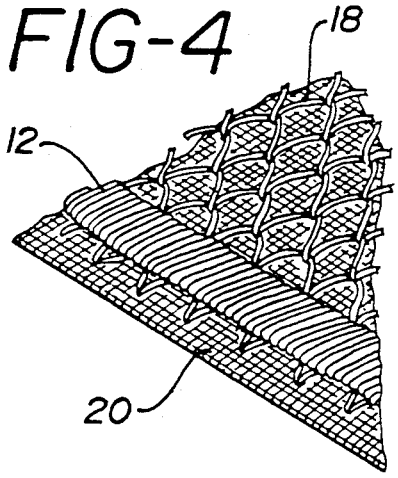
FIG. 4 is a perspective partial view of the design of FIG. 1 embroidered onto a base material.

Referring now to FIGS. 1 and 4 a perspective view of the double-embroidered lace 10 of the present invention may be seen. It is to be understood that the proportion and size of the stitching and the like has been slightly exaggerated for clarity purposes only. Additionally, although a particular design is shown, an infinite variety of patterns can and may be made without departing from the spirit and scope of the present invention.

It is to be understood that although many methods of manufacturing embroidery may be acceptable, in the preferred embodiment of the present invention a single or multi-head Schiffli embroidering machine (not shown) is preferred. A description of Schiffli embroidery is found in U.S. Pat. No. 4,788,922 to Clarius which is incorporated herein by reference. In this type of embroidery a needle or front yarn is used and therefore constructs a first layer while a bobbin or back yarn (not shown) is used to attach the front yarn to a base material. The fabric comprising the front thread which is to be sewn onto the base material is threaded through the needle eye on the front of the Schiffli loom. This thereby forms the top or front yarn of the embroidery, while the shuttle on the back of the loom is loaded with a cotton, nylon or other suitable yarn called the bobbin or back thread. During manufacturing, as the needle penetrates the fabric it is pumped twice at the back of its stroke thereby causing the needle to form a small loop. Contemporaneously, the shuttle moves upwards passing through the loop thus forming a stitch. The bobbin on the back thereafter pulls the needle yarn to the back of the fabric and thereby secures the front material to the base material as to form an embroidery or embroidered lace.

Accordingly, shown generally at 10 is a double-embroidered design for forming lace as envisioned by the present invention. More particularly, yarn borders, e.g. cotton or rayon, 12, 16 and cotton yarn design 14 comprise a second embroidered design which is overlaid onto a first embroidered design 18 which is a contrasting or complimentary yarn. In the preferred embodiment of the present invention, the second embroidered design 12, 14, 16 is of any suitable color, quality or type of material which will aesthetically coordinate with first embroidered design 18.

First embroidered design 18 preferably comprises a metallic, shiny or lustrous type of yarn, e.g. silver, gold, "mother-of-pearl" (pearlescent) (hereinafter referred to as lustrous) which has been found to pleasingly contrast with the non-metallic type yarn, i.e. second embroidered design 12, 14, 16 which is a yarn. Therefore, the shiny embroidered design 18 is visible through portions of the top or second embroidered design in order to create a contrasting look. It has also been found that the first embroidered design may be reversed thereby creating a still different contrasting look.

Figure 2:
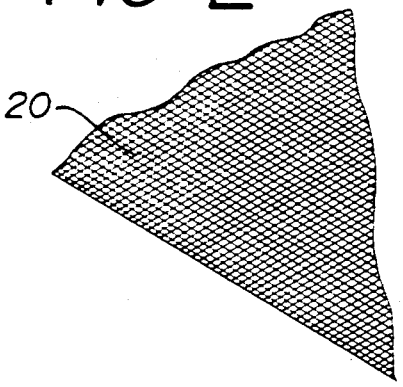
FIG. 2 is a partial view of the soluble base material as utilized in the present invention.
Figure 3:
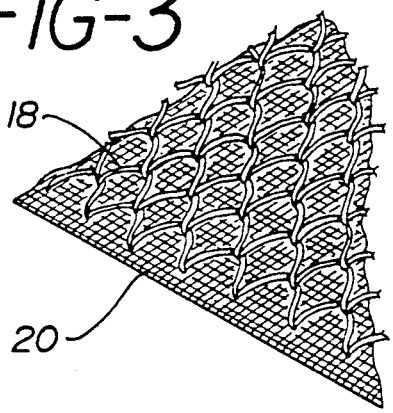
FIG. 3 is a partial view of a metallic yarn embroidered design embroidered onto the soluble base material of FIG. 2.

Referring now to FIGS. 2, 3 and 4, various phases of production of the present invention may be seen. In the preferred embodiment of the present invention, ground or base material 20 is soluble. Accordingly, it may be comprised of fabric or paper or any other suitable material which will dissolve or wash away once subjected to conventional removal techniques such as a bleach solution, hot water or the like. Therefore, once an embroidery is completed the base material 20 may be readily removed.

Sewn directly onto base material 20 is first embroidered design 18 which forms a background design and preferably comprises a lustrous type of yarn.

Once a first embroidery is run through a Schiffli machine, the second and subsequent embroidered design are thereafter run through another or the same Schiffli machine in successive or sequential steps in order to form overlays. Therefore, a plurality of Schiffli machines may be utilized or the same machine may be used.

When the first embroidered design 18 is embroidered onto base material 20, a second yarn such as cotton 12, 14 or 16 is embroidered directly on top of the first embroidered design 18. It is to be understood that a plurality of embroidered design may be utilized. Additionally, a plurality of patterns may be utilized on the same base material.

Figure 5:
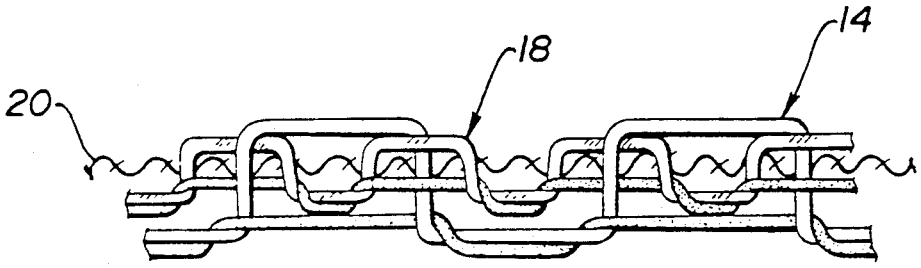
FIG. 5 is a magnified cross-sectional view of the embroidered fabric of this invention, including the base material.
Figure 6:
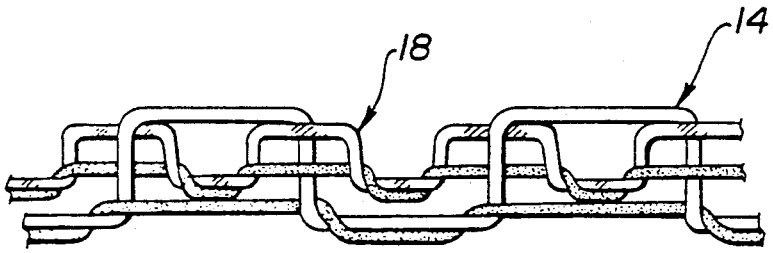
FIG. 6 is a magnified cross-sectional view of the embroidered fabric of this invention without the base material.

Referring now to FIGS. 5 and 6, cross-section and side views respectively of FIGS. 4 and 1 may be seen. Here, FIG. 5 illustrates the embroidered pattern with the base material 20 in place. FIG. 6 shows the same pattern with the base material 20 having been previously removed by dissolving or other suitable means.

It is to be understood that many variations of the present invention may be practiced without departing from the spirit and scope of the present invention. For example, other types of embroidery machines may be utilized or different types of base materials such as, adhesive styles may be utilized thereby allowing the double embroidery to be adhesively attached to a garment.

Having thus described the present invention in detail, it is to be understood that the foregoing description is not intended to limit the spirit and scope thereof. What is desired to be protected by letters patent is set forth in the pending claims.

I claim:

1. A Schiffli embroidered fabric, comprising:

a base material;

a first Schiffli embroidered design, embroidered onto the base material, the embroidered design comprising a metallic yarn selected from the group consisting of gold, silver, and pearlescent; and a second Schiffli embroidered design overlaying, at least in part, the first embroidered design, and embroidered onto the base material and the first embroidered design, the second design comprising a second yarn, wherein a portion of the metallic yarn is visible through a portion of the second embroidered design.

2. The embroidered fabric of claim 1, wherein the base material is soluble.

3. A Schiffli embroidered fabric, comprising:

a first Schiffli embroidered design, the embroidered design comprising a metallic yarn selected from the group consisting of gold, silver, and pearlescent; and a second Schiffli embroidered design overlaying at least in part, the first embroidered design, and embroidered on to the first embroidered design, the second design comprising a second yarn, wherein a portion of the lustrous yarn is visible through a portion of the second embroidered design.

4. A method of manufacturing a Schiffli embroidered fabric, comprising the steps of:

(a) embroidering on to a base material a first Schiffli embroidered design comprising a metallic yarn selected from the group consisting of gold, silver, and pearlescent; and (b) embroidering on to the base material and the first embroidered design, a second Schiffli embroidered design, the second embroidered design overlaying at least in part the first embroidered design and comprising a second yarn, wherein a portion of the metallic yarn is visible through a portion of the second embroidered design.

5. The method of claim 4, wherein the base material is soluble.

6. The method of claim 5, further comprising dissolving the base material.

* * * * *